US005314219A

United States Patent [19]

Georgopoulos et al.

[11] Patent Number: 5,314,219

[45] Date of Patent: May 24, 1994

[54] PADLOCK-TYPE SECURITY SEAL HAVING A LOCKING INSERT FIXED IN A HOLLOW BODY AND METHOD OF MAKING SAME

[75] Inventors: George Georgopoulos, Pine Brook; Ritchie J. Fullerton, Hillside; Louis J. Mattos, Carteret, all of N.J.

[73] Assignee: E. J. Brooks Company, Newark, N.J.

[21] Appl. No.: 23,576

[22] Filed: Feb. 26, 1993

[51] Int. Cl.[5] ..... B65D 33/34

[52] U.S. Cl. ..... 292/320

[58] Field of Search ..... 292/320, 307, 316, 323; 70/53

[56] References Cited

U.S. PATENT DOCUMENTS

| | | | |
|---|---|---|---|
| 3,485,521 | 12/1969 | Moberg | 292/320 |
| 4,278,281 | 7/1981 | Moberg | 292/320 |
| 4,687,240 | 8/1987 | Swift | 292/320 |
| 4,775,175 | 10/1988 | Swift | 292/320 |
| 4,832,387 | 5/1989 | Guiler | 292/320 |
| 4,893,853 | 1/1990 | Guiler | 292/320 |

*Primary Examiner*—Richard E. Moore

*Attorney, Agent, or Firm*—John G. Gilfillan, III; William Squire

[57] ABSTRACT

A padlock type security seal and method of making same include a U-shaped shackle, a pair of reversely bent end portions, and a transparent body having a pair of chambers for receiving the bent end portions. The chambers each have a locking groove therein for receiving the bent end portions. The seal elements are formed from two molded thermoplastic pieces, an insert and a body. The relative dimensions of the chambers, the shackle, and the locking grooves are chosen to prevent picking.

The insert has a channel in which a liquid filled vial is inserted. The vial contains a colored liquid. When the shackle is attempted to be removed from the body portion, the shackle end portions penetrate the insert and the vial causing the liquid to seep into the various chambers, the seepage being visible through the body.

30 Claims, 3 Drawing Sheets

FIG. 1
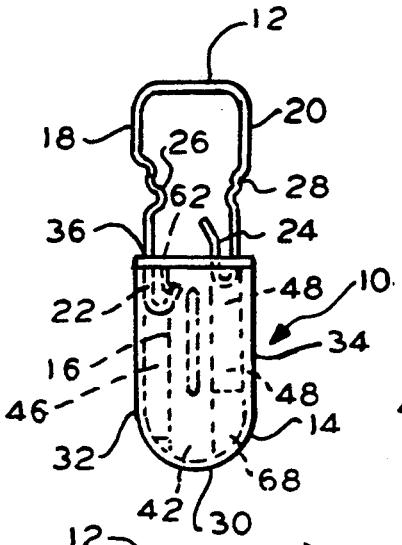
FIG. 2
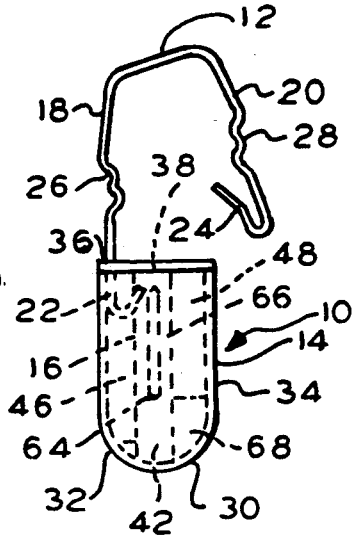
FIG. 3
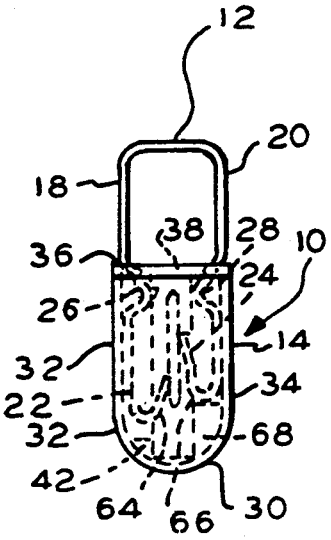
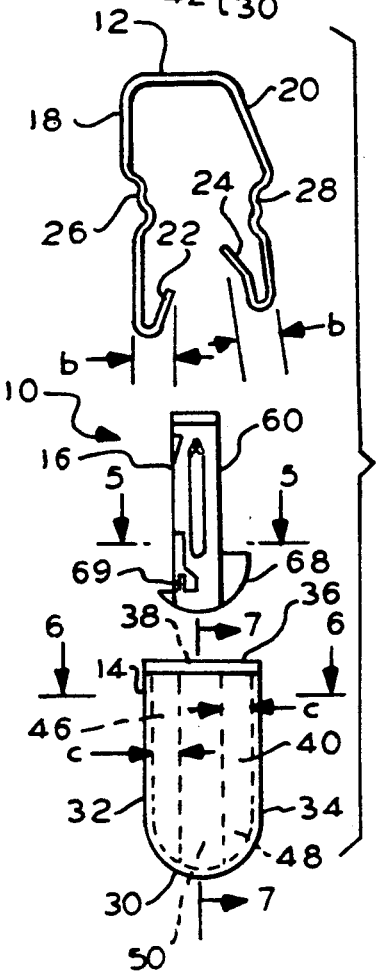
FIG. 4
FIG. 5
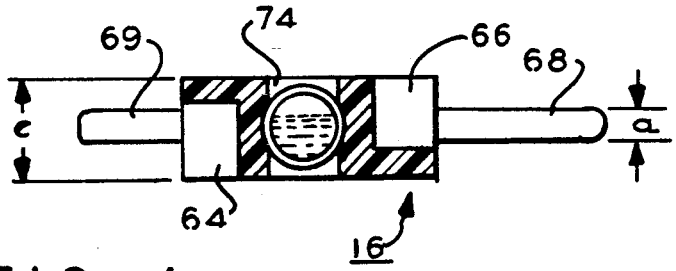
FIG. 6
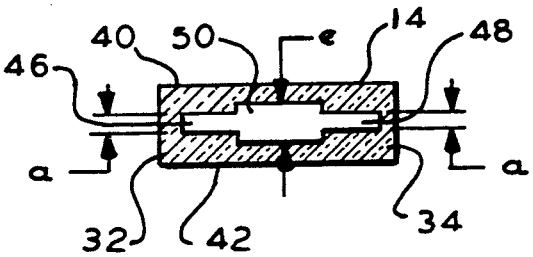

PADLOCK-TYPE SECURITY SEAL HAVING A LOCKING INSERT FIXED IN A HOLLOW BODY AND METHOD OF MAKING SAME

BACKGROUND OF THE INVENTION

The present invention relates to a high security seal of the padlock type and, more particularly, to a seal having a wire shackle that is first threaded through a structure to be secured and then locked in a seal body such that the seal must be broken to be opened. The present invention also relates to a method of making such seals.

Security seals of the padlock type are generally well known, and they have found wide spread use for sealing structures such as currency bags, closures, electric meters, and the like. Examples of such seals may be found in the following U.S. Patents: U.S. Pat. Nos. 3,485,461; 3,373,033; 3,980,332; 4,353,583; 4,278,281; 4,687,240; 4,832,387 and 4,775,175.

All of these seals have, generally, a plastic body with a pair of spaced cavities in which a U-shaped shackle is permanently locked. Locking the shackle is typically accomplished by a pair of reversely bent, resilient legs that register with a bump or depression located in the spaced cavities.

The present invention is an improvement of the security seal disclosed in these latter two patents. In the '175 Patent, the plastic body of the seal disclosed therein includes a central cavity in which an ampule containing a liquid, which may be brightly colored, is inserted. When the reversely-bent, sharp ends of the shackle, located within the plastic body of the seal, are attempted to be removed from the body, penetrate into the central chamber and shatter the impule, cause the liquid therein to seep from the central chamber through the ruptured sidewalls of that chamber. Also, an external aperture is provided over the central chamber to permit the liquid to seep into the ambient atmosphere region of the plastic body. When the liquid seeps through the ruptured sidewalls, it may or may not reach the shackle openings and therefore be visible external the plastic body. The plastic body is opaque and, therefore, the liquid is required to seep to an external region in order to be visible. Observation of the liquid external the body indicates tampering with the seal.

In the '387 Patent, a padlock-type security seal having a shackle and a plastic body and an insert are disclosed. The insert and plastic body are opaque and, in contrast to the '175 Patent, no liquid is used in this embodiment, as disclosed in the '387 Patent. The problem with this structure is that, when the shackle is attempted to be removed from the locked engaged position within the padlock, the sharp, reversely-bent ends of the shackle within the padlock are forced against the insert and then are bent outwardly and penetrate through the padlock body case. The present invention is a recognition of the problems associated with the above two described patents and it is an improvement thereover.

SUMMARY OF THE INVENTION

A security seal in accordance with one embodiment of the present invention comprises a transparent seal body having adjacent first and second chambers therein. A liquid is contained in the first chamber and a shackle has at least one leg and includes means for locking the leg in the second chamber and for rupturing the first chamber to permit the liquid to seep from the first chamber when a force is exerted to unlock the leg. As a result, because the seal body is transparent, the tampering is readily observable without the liquid having to first seep external the seal body.

In accordance with a second embodiment, a U-shaped resilient shackle has first and second legs, each having a reversely-bent end-portion. A hollow seal body has an aperture in one side thereof. A hollow insert is fixed in the hollow interior of the hollow seal body, the insert having a first chamber. The insert and the hollow seal body define elongated second and third chambers which are contiguous with the aperture. The insert has first and second recesses on respective opposed sides thereof in respective communication with the second and third chambers. A frangible vial having a liquid therein is located in the first chamber. The reversely-bent end-portions are bent through an angle such that the sharp edges are respectively in a different recess when the legs are inserted in the first direction into the chambers. The force of the sharp edges against the insert and the strength of the insert are such that, upon sufficient movement of the shackle in the second and third chambers in the direction opposed to the direction, the sharp edges penetrate the insert, into the first chamber and shatter the vial, whereby the liquid escapes from the vial.

In accordance with the method of the present invention for forming a security seal, a body is formed with the first chamber. A member is formed with a second chamber, the member being dimension to be received in the first chamber to form at least one third chamber in the body. A liquid is placed in the second chamber. The member and the liquid are then inserted in the first chamber. A shackle is formed having at least one leg, including means for locking the one leg in the third chamber and for rupturing the second chamber to permit the liquid to a discharge from the second chamber in response to a force directed to unlock the one leg.

BRIEF DESCRIPTION OF THE DRAWINGS

FIGS. 1–3 are side elevation views of a preferred embodiment;

FIG 4 is an exploded view of the embodiment of FIGS. 1–3;

FIG. 5 is a sectional-view taken along lines 5—5 of FIG. 4;

FIG. 6 is a plan view of the body of the preferred embodiment;

DETAILED DESCRIPTION OF THE PREFERRED EMBODIMENTS

Figure 7:
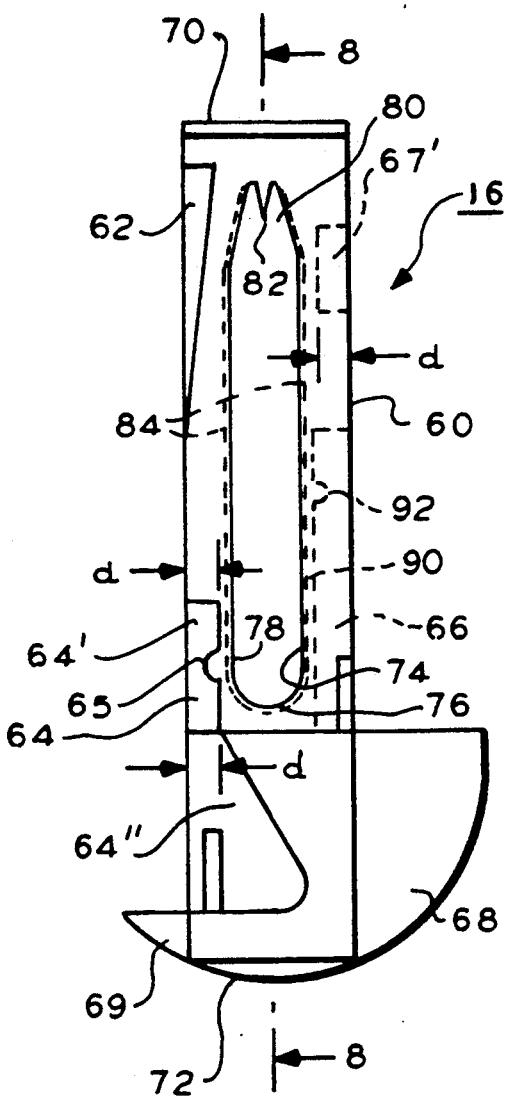
FIG. 7 is a side elevation view of an insert of the preferred embodiment.

Like reference numerals refer to like parts throughout. In FIGS. 1–4, a security seal 10 has a resilient shackle 12, seal body 14, and an insert 16. The resilient shackle 12, formed of spring wire, is generally U-shaped with a long leg 18 and a short leg 20. Legs 18 and 20 have reversely bent end portions 22 and 24, respectively, with sharp ends. Legs 18 and 20 are also formed with anti-picking bumps 26 and 28, respectively.

The seal body 14 is made of transparent molded plastic that forms a flat, thin, generally rectangular box having a narrow curved bottom wall 30, two parallel narrow side wails 32 and 34, and a narrow top wall 36 with an opening 38 therein. The narrow walls, 30, 32, 34 and 36 are joined by broad side walls 40 and 42 to define a narrow hollow interior. The hollow interior, FIG. 6, comprises parallel side channels 46 and 48 of equal thickness joined by a thicker central channel 50.

In FIG. 7, insert 16, preferably molded thermoplastic, has an elongated body 60 with overall dimensions substantially the same as that of channel 50, FIG. 6. A tapered groove 62 is formed in one side and near one end 70 of the insert 16. The depth of the groove 62 increases as it approaches the one end. A second groove 64 is formed in the same side as groove 62, but is near the opposite end 72 of the body 60. Groove 64 has a rectangular section 64' and an enlarged section 64''. A projection 65 upstands from the base of the groove 64 within the rectangular portion 64'. A rectangular recess 67' is formed near the one end 70 on the opposite side of the insert 16. A second rectangular groove 66 is formed on that opposite side medially of the ends 70 and 72. A stop flange 68 is located at end 72 and extends from one side of the insert body 60. A tab 69 extends from the opposite side of the body 60 at end 72. The peripheral surface of tab 69, end 72 and flange 68 are generally circular and are closely received within the hollow interior of the body 14, FIGS. 1–4. The insert 16 body 60 between ends 70 and 72 is rectangular in shape and is closely received within channel 50 of the body 14, FIG. 6. Flange 68 has a thickness so as to be closely received within channel 48, FIG. 6, of the body 14 and tab 69 is closely received in channel 46.

In FIG. 7, the insert 16 includes an elongated central channel 74. Channel 74 has an arcuate end 76 adjacent to groove 64. The channel 74 terminates in a region slightly spaced from a plane passing through an edge of flange 68 distal end 72. Channel 74 creates a relatively thin wall 78 with groove 64. For example, wall 78 may have a thickness of 0.025". Channel 74 extends towards end 70 and terminates in a tapered, narrow region 80. A flap 82 depends into the region 80 central the channel 74. A groove 84 in the body 60 in channel 74 extends around the sides of the channel. The groove 84 is a segment of a circle. Channel 74 forms a relatively thin wall 90 with the groove 66 having approximately the same thickness as the wall 78. A projection 92 is upstanding within groove 66 adjacent the end of the groove closest to end 70 but spaced therefrom.

Figure 8:
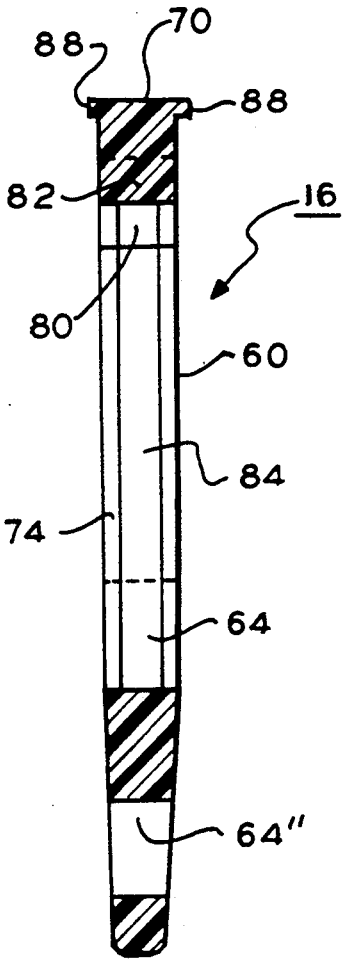
FIG. 8 is a sectional view of the insert of FIG. 7 taken along lines 8—8.
Figure 9:
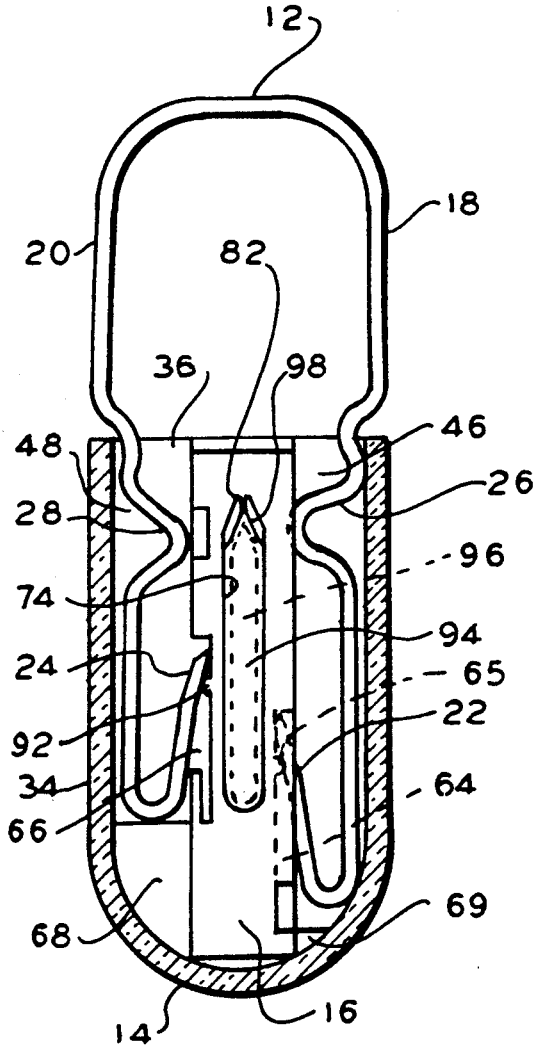
FIG. 9 is elevation sectional view of the embodiment of FIG. 3.

In FIG. 9, a vial 94, preferably of glass or frangible plastic or other frangible material, contains a liquid 96, which is a colored dye such as a food coloring added to a glycerine or alcohol or a combination of both. This is a non-toxic UV-stable color, preferably of a brightly colored hue. When alcohol is used, it evaporates, the colored liquid disappears and indicates tampering. The combination of alcohol and glycerine dissipate easier from the broken vial and create a spotty stain that is readily visible. The vial 94 has a tapered end 98. The tapered end is held in place by flap 82 to keep the vial from shaking in place and preventing it from shattering due to vibrations. The vial 94 is located in channel 74, FIG. 7, and snap-fitted in place into the grove 84, wherein the vial is closely received. Channel 74, extends through the insert body 60, FIG. 8, to opposite sides and exposes the vial 94 to both of the broad sides of the insert 16. That is, the vial 94 is in communication with both these sides via the channel 74. The vial, however, is locked in place via the flap 82 and the groove 84.

The thickness of the wire that forms shackle 12, the thickness of side channels 46 and 48, and the width of grooves 62, 64 and 66 are all equal and designated in the drawings by the letter (a). The unstressed widths of the reversely bent end portions 22 and 24 are equal and designated by the letter (b). The widths of channels 46 and 48 are equal and designated by the letter (c). The depth of the grooves 64 and 66 are equal and designated by the letter (d).

The insert 16 with the vial 94 inserted in channel 74 is assembled to the seal body 14 within the channels 46, 48 and 50. The shoulders 88, FIG. 8, of the insert 16 mate in a corresponding recess in the end of the body 14. When fully seated, the flange 68 abuts the bottom of the channel 48 and the tab 69 abuts the bottom of channel 46, whereas the surface at end 72 abuts the bottom of the channel 50. Flange 48 and tab 69 in the bottom of the insert body 60 are ultrasonically welded to the seal body 14 to permanently secure the insert 16 in the body 14 channels. In this position, the vial 94, FIG. 9, is sandwiched between the broad sidewalls of the seal body 14 and is visible through the transparent body 14. The liquid inside the vial 94, which is transparent, is also visible external the body 14.

The operation of the seal 10 is as follows. The seal 10 is shipped in the position shown in FIG. 1, i.e., with the reversely bent end portion 22, on long leg 18, inserted in channel 46 and mating with groove 62 to hold the shackle 12 in place. A small portion of the reversely bent end portion 24 on leg 20 in inserted in channel 48. In this position, the seal 20 is said to be closed. When it is desired to seal a structure, the seal 10 is opened to the position shown in FIG. 2 by removing the short leg 20 from channel 48 and threading it through the structure to be sealed. The short leg 20 is then replaced in channel 48 and the seal 10 is locked by pushing the shackle 12 into the channels 46 and 48 until both legs 18 and 20 have their reversely bent end portions 22 and 24 locked in grooves 64 and 66, respectively, as shown in FIGS. 3 and 9. During this locking operation, the reversely bent end portions 22 and 24 are compressed by the walls of the channels 46 and 48. Such compression does not exceed the elastic limit of the material of the shackle. Thus, when the end portions 22 and 24 are fully inserted, they expand and snap into groves 64 and 66, respectively.

As seen in FIG. 9, the bent end portions 22 and 24 of the shackle 12 abut projections 92 and 65, respectively. The sharp ends of the portions 22 and 24 face inwardly toward the channel 74 and abut the partition walls formed by the respective grooves 64 and 66. The projections 65 and 92 maintain the sharp edges pointed toward the abutting insert partition sidewalls of the insert. The sharpened edges of the shackle at the bent portion ends are in tight engagement against those sidewalls due to the resilient nature of the spring raw material of the shackle 12 and the squeezing of the end portions 22 and 24 during insertion of the legs 18 and 20 into the body 14. The aforementioned U.S. Pat. Nos. 4,775,175 and 4,832,387 mentioned in the introductory portion are incorporated by reference herein, and provide a further description of the function and relationship of the shackle 12 to the overall structure being described therein. This overall structure includes the relative dimensions of the channels and the shackle for operating in the manner intended.

When the shackle 12 is in the locked position as shown in FIG. 9, any attempt to remove the shackle 12 in the direction to force the shackle legs 18 and 20 out of the channels 46 and 48 will cause the sharpened, reversely bent end-portions 22 and 24 to penetrate the partition walls of the insert 16 and penetrate into the channel 74 of the insert. The sharpened end portions continue to penetrate into the channel 74 and shatter or otherwise penetrate the vial 94. When the vial 94, either plastic or glass, shatters or otherwise breaks upon penetration by the shackle end portions, the liquid 96 therein escapes through the openings formed by the penetrating end portions and seeps into the channels 46 and 48. Also, the liquid may seep throughout channel 74. Whether or not the liquid seeps into the channels 46 and 48 or into channel 74, it may seep into all or any of such channels. The liquid being a brightly colored dye is immediately visible through the walls of the body 14 of the seal. Thus, any attempt to tamper with the shackle 12 by removing it and causing penetration of the vial 94 immediately shows the tampering. In this regard, the liquid 96 in the vial 94 need not escape to the ambient region outside of the shackle, as occurs in the prior art. Therefore, immediate evidence of such tampering is presented by any seepage of liquid.

The insert 16 is formed as a fairly rigid beam-like structure having smooth, continuous surfaces, thereby making it ideally suited for easy assembly by sliding through the opening 38 into the central channel 50 in seal body 14. The flange 68 is dimensioned to slide into channel 40 as insert 16 is assembled. The insert 16, after insertion, may be conveniently secured by any standard means, including the ultrasonic weld mentioned previously.

The insert, because it has the channel 74, is relatively Weakened by the sidewalls forming the partition walls between the channel 74 and the channels 46 and 48. It is preferred, therefore, that, whether or not the insert is used with a liquid-filled vial 94, that an empty vial 94 without a liquid therein, also be located within the channel 74 to provide added strength to the insert. This is because the walls 78 and 90 are relatively thin, as mentioned, and therefore the insert itself may be relatively fragile. The vial 94 thus provides a stronger combined structure for the insert to permit the insert to be handled during manufacture and assembly. When the insert has no vial, the shackle thus penetrates the insert channel 74 rather than the body 14.

Figure 10:
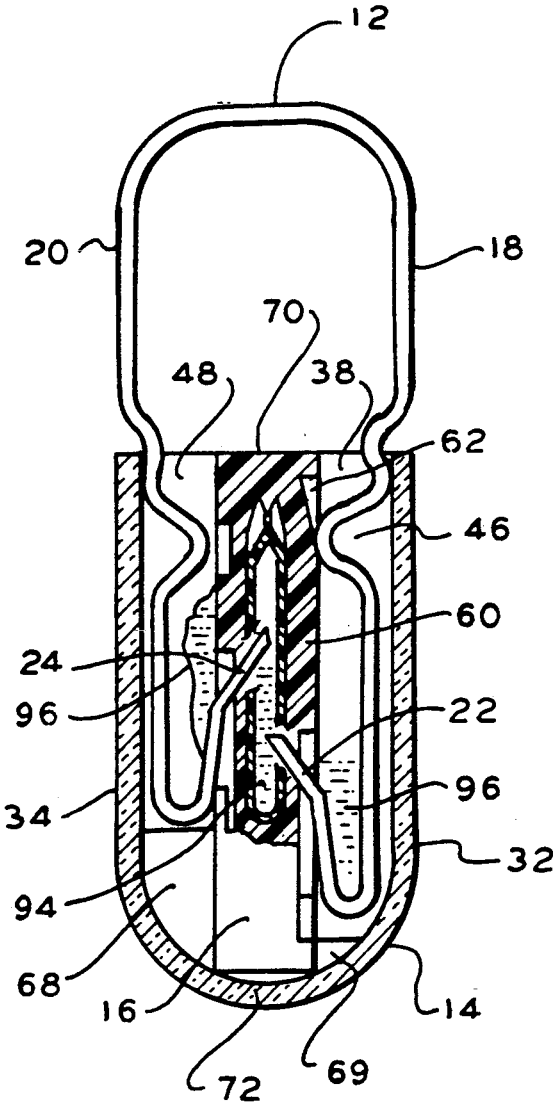
FIG. 10 is a view similar to that of FIG. 9 showing tampering of the seal.

In FIG. 10, the shackle 12 has been pulled somewhat in an attempt to remove it from the body 14. In this orientation, the bent end-portions 22 and 24 have penetrated the partition sidewalls of the insert in the grooves 64 and 66 and have also penetrated into the vial 94, releasing the liquid 96. The liquid 96 seeps out of the ruptured openings and coats the body 14 transparent sidewalls and is readily visible to an observer.

While the insert with the vial and liquid filled therein are preferable, it is possible to employ the insert without a vial and without the liquid therein or with an empty vial with no liquid therein. It is preferable that either an empty vial or a liquid-filled vial be used as compared to no vial, as discussed above. While two channels 46 and 48 and two end portions 40 shackle are as shown, it is contemplated that the seal of the present invention may be incorporated with a single channel and a single shackle leg portion. This may be useful in certain implementations where the shackle wire is permanently secured to some other apparatus and is desired to seal that apparatus with the seal in which the seal body is attached to some other structure element or arrangement. For example, the shackle wire may be passed through a small opening in a sheet material and the seal body may be attached to the bent end portion on one side of the sheet metal and the other end of the shackle wire permanently secured to some other structure, therefore, securing the sheet metal between the seal member and that other structure.

Other modifications are contemplated and are believed to be within the skill of those of ordinary skill in the art without departing from the spirit and the scope of the invention as defined by the appended claims.

What is claimed is:

1. A security seal comprising:

a transparent seal body having adjacent first and second chambers therein;

a liquid contained in said first chamber;

a shackle having at least one leg including means for locking said leg in said second chamber and for rupturing said first chamber to permit said liquid to seep from said first chamber when a force is exerted to unlock said leg; and a member secured to said body in said second chamber, said body and said member forming said first chamber, said member being arranged such that the first and second chambers are visible through said body, said member having a channel therethrough in communication with opposing sides of said member, said body having opposing sides, said channel being visible through each said body opposing sides.

2. The security seal according to claim 1 wherein said liquid is of such composition that it can be visually detected through said body.

3. The security seal of claim 1 further including a sealed frangible vial containing said liquid and located in said first chamber.

4. The security seal of claim 1 wherein said member is opaque.

5. The security seal of claim 1 wherein said body has opposing sides, said member being constructed so that said first chamber is visible through each said opposing sides.

6. A security seal comprising:

a resilient shackle having at least one leg with a reversely bent end portion terminating in a sharp edge;

a transparent seal body having a first chamber therein for receiving said reversely bent end portion;

a second chamber positioned in said body adjacent said first chamber and separated therefrom by a partition;

a liquid contained in said second chamber;

said reversely bent end portion being bent through an angle such that said sharp edge is compressed against said partition when said reversely bent end portion is inserted, in a first direction, into said chamber;

the compressive force of said sharp edge against said partition and the strength of said partition are such that upon sufficient movement of said shackle in said first chamber, in a direction opposite to aid first direction, said sharp edge penetrates said partition and enters said second chamber, whereby said liquid seeps from said second chamber; and an opaque member in said first chamber and forming said second chamber, said opaque member being arranged such that said second chamber is visible through said seal body, said member forming said partition.

7. The security seal of claim 6 wherein said member forms said first chamber into third and fourth chambers, said shackle having a pair of said at least one leg, said third chamber for receiving one of said pair of legs and the fourth chamber for receiving the other of said pair of legs.

8. The security seal of claim 6 including a frangible vial containing said liquid in said second chamber, said sharp edge penetrating said seal and releasing said liquid upon said sharp edge penetrating said partition.

9. A security seal comprising:

a U-shaped resilient shackle having first and second legs, each having a reversely bent end portion terminating in a sharp edge;

a transparent seal body having spaced elongated first and second generally parallel chambers, each terminating in a corresponding aperture located in said seal body for receiving a different one of said legs;

a third chamber positioned in said body adjacent said first and second chambers and separated therefrom with first and second partitions, respectively;

a liquid contained in said third chamber;

said partitions each having a recess in communication with a respective corresponding different one of said first and second chambers such that each said reversely bent end portions correspond to and are located in a different recess, said sharp edges being forced against said partitions in such recesses when said legs are slideably inserted in a first direction into said chambers; and wherein the force of said sharp edges and the strength of said partitions are such that upon sufficient movement of said shackle, in a direction opposed to said first direction, said sharp edges penetrate said partitions, enter said third chamber, and cause said liquid to be discharged from said third chamber.

10. The security seal of claim 9 including a member secured to said body in said third chamber, said member forming with said body said first and second chambers, said member being arranged such that the first and second chambers are visible through said body.

11. The security seal of claim 10 wherein said member forms a fourth chamber, said seal further including a sealed frangible vial containing said liquid and located in said fourth chamber.

12. A security seal comprising:

a U-shaped resilient shackle having first and second legs each having a reversely bent end portion;

a hollow seal body having an aperture in one side thereof;

a hollow insert fixed in a hollow interior of said hollow seal body, said insert having a first chamber;

said insert and said hollow seal body defining elongated second and third chambers contiguous with said aperture;

said insert having first and second recesses on respective opposed sides thereof in respective communication with said second and third chambers;

a frangible vial having a liquid therein located in said first chamber;

said reversely bent end portions being bent through an angle such that said sharp edges are respectively in a different recess when said legs are inserted in a first direction into said respective second and third chambers; and wherein the force of said sharp edges against said insert and the strength of said insert are such that, upon sufficient movement of said shackle in the second and third chambers in a direction opposed to said first direction, said sharp edges penetrate said insert, enter said first chamber, and break said vial, whereby said liquid escapes from said vial.

13. The seal of claim 12 wherein the body is sufficiently transparent such that said first chamber is visible through said body.

14. The seal of claim 12 wherein the body has opposing relatively broad sides, said hollow interior of said body defining a first elongated channel of a first width, said insert having an elongated second channel located in said first chamber and forming said first chamber with said broad sides, said second channel being contiguous with each said broad sides.

15. The seal of claim 14 wherein the hollow interior of said body defines second and third opposing channels each of a width narrower than the first channel and located in opposite sides of said insert, said insert including first and second tabs extending therefrom and engaged with a different one of said second and third channels.

16. The seal of claim 15 wherein said tabs are located distal said aperture, said hollow interior being enclosed adjacent to said tabs.

17. The seal of claim 12 including means for locking said insert into said hollow interior.

18. A method of forming a security seal comprising:

forming a body with a first chamber;

forming a member with a second chamber, said member having dimensions to be received in said first chamber to form at least one third chamber in said body;

placing a liquid in the second chamber;

inserting the member and liquid in said first chamber; and forming a shackle having at least one leg including means for locking said one leg in said third chamber and for rupturing said second chamber to permit said liquid to discharge from said second chamber in response to a force directed to unlock said one leg.

19. The method of claim 18 including forming a fourth chamber from said first chamber with said member and forming the shackle with a second leg including means for locking the second leg in the fourth chamber and for rupturing the second chamber in response to a force directed to unlock the second leg.

20. The method of claim 18 including forming said body from material sufficiently transparent such that said liquid is visible through said body.

21. The method of claim 18 wherein said placing said liquid includes placing a liquid filled vial in said second chamber and then inserting said member and vial into said first chamber.

22. The method of claim 21 including locking the member in said first chamber.

23. The method of claim 21 wherein said forming said member includes forming a channel in said member in communication with opposing member sides so the channel is contiguous with said body and said opposing sides.

24. The method of claim 18 including forming the liquid with a color.

25. A security seal comprising:

a U-shaped resilient shackle having first and second legs each having a reversely bent end portion;

a hollow seal body having an aperture in one side thereof;

a hollow insert fixed in a hollow interior of said hollow seal body, said insert having a first chamber;

said insert and said hollow seal body defining elongated second and third chambers contiguous with said aperture;

said insert having first and second recesses on respective opposed sides thereof in respective communication with said second and third chambers; and said reversely bent end portions being bent through an angle such that said sharp edges are respectively in a different recess when said legs are inserted in a first direction into said respective second and third chambers; the force of said sharp edges against said insert and the strength of said insert are such that, upon sufficient movement of said shackle in the second and third chambers in a direction opposed to said first direction, said sharp edges penetrate said insert and enter said first chamber.

26. The security seal of claim 25 including a frangible vial located in the seal first chamber.

27. The security seal of claim 26 wherein the frangible vial has a liquid therein.

28. The security seal of claim 27 wherein the liquid includes alcohol.

29. The security seal of claim 27 wherein the liquid contains a food coloring.

30. A security seal comprising:

a transparent seal body having adjacent first and second chambers therein:

a liquid contained in said first chamber;

a shackle having at least one leg including means for locking said leg in said second chamber and for rupturing said first chamber to permit said liquid to seep from said first chamber when a force is exerted to unlock said leg; and a member secured to said body in said second chamber, said body and said member forming said first chamber, said member being arranged such that the first and second chambers are visible through said body, said body having opposing sides, said member being constructed so that said first chamber is visible through each said opposing sides.

* * * * *